United States Patent [19]

Aldag et al.

[11] 4,245,828

[45] Jan. 20, 1981

[54] APPARATUS FOR FABRICATION OF METAL BUILDINGS

[75] Inventors: John Aldag, Chicago, Ill.; Willis L. Wells, Clayton, Mo.

[73] Assignee: Blackhawk Systems, Inc., Chicago, Ill.

[21] Appl. No.: 903,753

[22] Filed: May 8, 1978

[51] Int. Cl.[3] ..... B23Q 3/00

[52] U.S. Cl. ..... 269/228; 269/303; 269/910

[58] Field of Search ..... 269/321 F, 228, 303-306, 269/37; 144/288 R; 100/DIG. 13

[56] References Cited

U.S. PATENT DOCUMENTS

| | | | |
|---|---|---|---|
| 2,129,133 | 9/1938 | Iben | 269/306 |
| 3,238,867 | 3/1966 | Jureit et al. | 269/321 F |
| 3,332,679 | 7/1967 | Junk | 269/321 F X |
| 3,933,348 | 1/1976 | Tidwell | 269/321 F X |
| 3,945,630 | 3/1976 | Brunemann | 269/321 F |

*Primary Examiner*—Robert C. Watson

*Attorney, Agent, or Firm*—Kinzer, Plyer, Dorn & McEachran

[57] ABSTRACT

An apparatus for fabricating, assembling and erecting the frame for a steel building, in which the frame is made up of a set of modular truss units which are joined together at the building site. The individual components of each truss unit are fabricated at a central location and are then shipped to an assembly location near the building site. At the assembly location, the components are welded together, prior to shipment to the building site, by use of special welding jigs.

5 Claims, 7 Drawing Figures

APPARATUS FOR FABRICATION OF METAL BUILDINGS

BACKGROUND OF THE INVENTION

This invention relates to construction of light metal buildings and particularly buildings for farm and rural use. In the past, this market has not been supplied with an economical, readily available structure. This has largely been due to the inability of centralized manufacturing operations to supply the inherently diffuse rural market. Use of multiple plant locations has not been an effective solution, because any single plant does not have a large enough market to support the facilities required.

Consequently, the tendency has been to build large rigid structures at central locations and employ them for buildings in the immediately surrounding areas. Such structures are often unduly expensive because of high shipping costs and the substantial foundations needed to support them. Construction costs are likewise increased by heavy equipment necessary to erect the rigid structures. Cross-tied foundations and concrete floors are frequently necessary. These factors combine to make steel farm buildings prohibitively expensive; areas remote from manufacturing centers are often unable to obtain such buildings at anywhere near reasonable cost.

SUMMARY OF THE INVENTION

A primary object of this invention is to provide a new and improved method and apparatus for economical fabrication and erection of metal buildings, particularly farm buildings.

Another object is to provide a new and improved method and apparatus for assembly and erection of metal buildings which allows those buildings to be readily distributed throughout a wide area.

Another object is to provide metal buildings which do not require heavy equipment to erect them.

Another object is to provide metal buildings which have practically zero outward thrust at the foundation, so that a substantial foundation is not required.

Accordingly, in one aspect the invention is directed to a method of fabricating, assembling, and erecting the frame for a steel building; the method comprises the steps of:

(1) Fabricating a multiplicity of individual truss components having standardized sizes and configurations at a central location;

(2) Shipping the individual truss components to an assembly location near the building site;

(3) Welding the individual truss components together in predetermined combinations and configurations, using standardized jigs, to form the components into a plurality of modular truss units;

(4) Shipping the truss units to the building site; and (5) Erecting the building frame by joining the truss units together in a plurality of aligned, interconnected truss assemblies at the building site.

The jig used for assembling the truss components for welding comprises a frame having first and second longitudinal members and first and second end members joined in a generally quadri-lateral fashion to form a frame. The main truss beams are placed in the jig in such a way as to be contiguous with the first and second longitudinal members. The frame is rotatably supported, by appropriate mounting means, at a height suitable for welding. The jig includes a series of locators that are adjustable to abut the main truss beam ends, holding the beams in the frame during welding. Alignment means are disposed along the frame for locating and anchoring strut and cross braces at the proper positions and angles for the particular truss configuration.

DESCRIPTION OF THE PREFERRED EMBODIMENT

Figure 1:
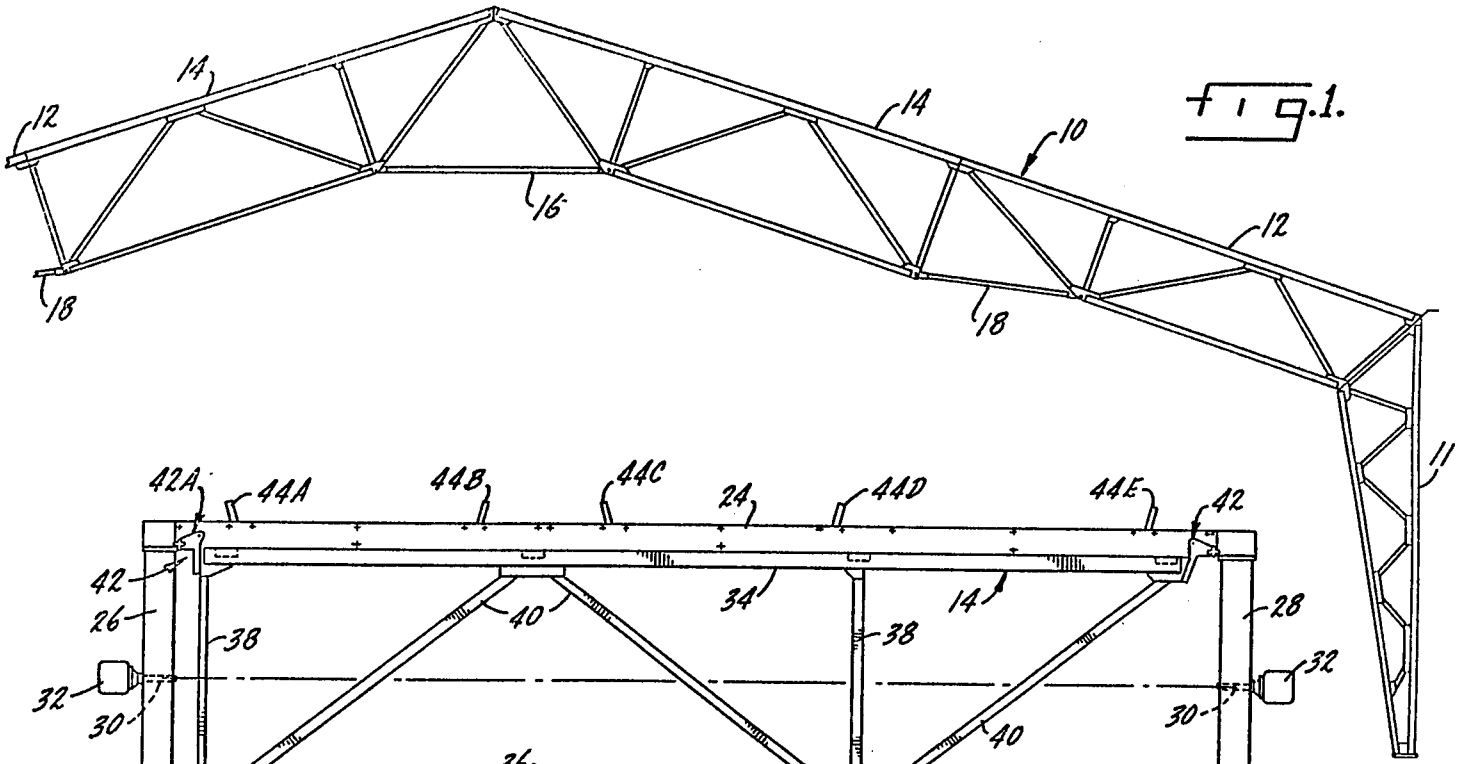
FIG. 1 is an elevation view of a building frame constructed in accordance with the present invention.

The present invention is directed toward light metal buildings particularly suitable for farm and other rural uses. More particularly, it is directed to a method and apparatus for constructing a steel framework for such a building. A partial view of one transverse frame section 10 is shown in FIG. 1. A completed building would include a plurality of such frame sections, spaced from each other and joined by longitudinal connecting frame members; total number of transverse frame sections in any building depend on the size of the particular building and its load (strength) requirements. The longitudinal connectors include stringers or purlins connected to the wall and roof segments of the transverse frame sections, which are covered by suitable sheet materials to complete the structure. Such a completed structure is disclosed and claimed in the co-pending application of John Aldag and Willis L. Wells, Ser. No. 903,752, now U.S. Pat. No. 4,201,021 filed concurrently herewith.

Figures 2, 4, 5:
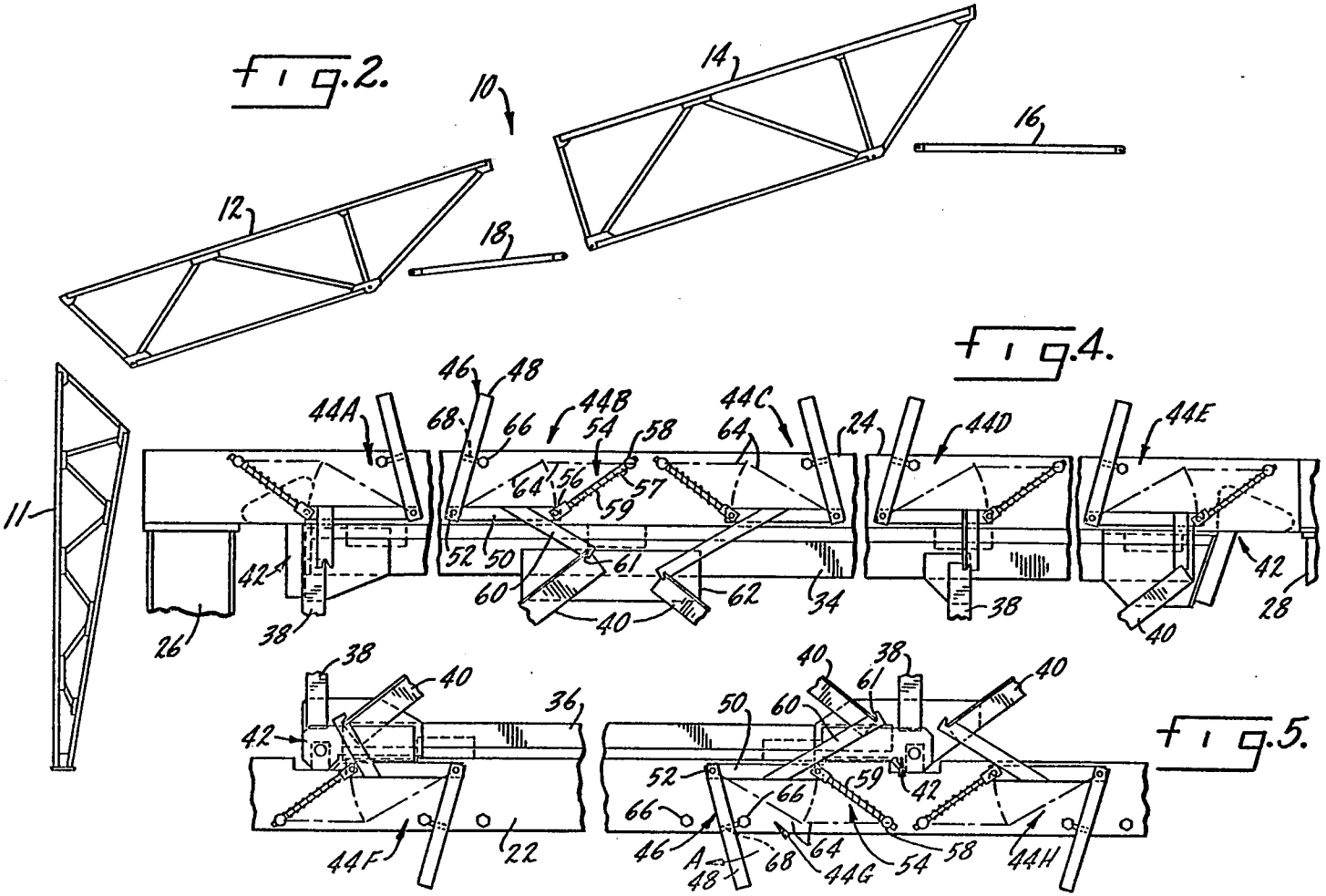
FIG. 2 is an exploded elevation view of half of the building frame section with the individual modular truss units shown separately.
FIGS. 4 and 5 are plan views, on an enlarged scale, of the alignment means incorporated in the jig of FIG. 3.

The left half of frame section 10 (FIG. 1) is shown broken down into its component truss units in FIG. 2. These sections include a lower truss 11, a middle truss 12, and an upper truss 14. The right side of the frame sections includes the same truss components; see FIG. 1. An upper tie bar 16 connects the bottom stringers of the upper trusses 14. A lower tie bar 18 serves a similar function between the upper and middle trusses 12 and 14.

Each modular truss unit is prefabricated before reaching the building site. The individual components of the modular truss unit are welded together using a jig 20 like that shown in FIG. 3. This particular jig 20 is used in fabrication of the upper truss modules 14.

Jig 20 comprises first and second longitudinal members 22 and 24. These are rigidly connected at their ends by two end members 26 and 28. End members 26 and 28 are journalled on two shafts 30 which are rotatably mounted in two supports 32, so that the entire jig frame can be rotated to any position convenient for welding operations.

As is apparent from the shape of the modular truss units 11, 12 and 14, FIGS. 1 and 2, a separate jig is required for each truss module. The frames of these jigs will have different shapes, with each one generally outlining the modular truss unit to be welded therein. In all other respects, the jigs for the different truss modules are essentially similar to each other, so that the jig 20 may be considered representative of them all.

Figure 3:
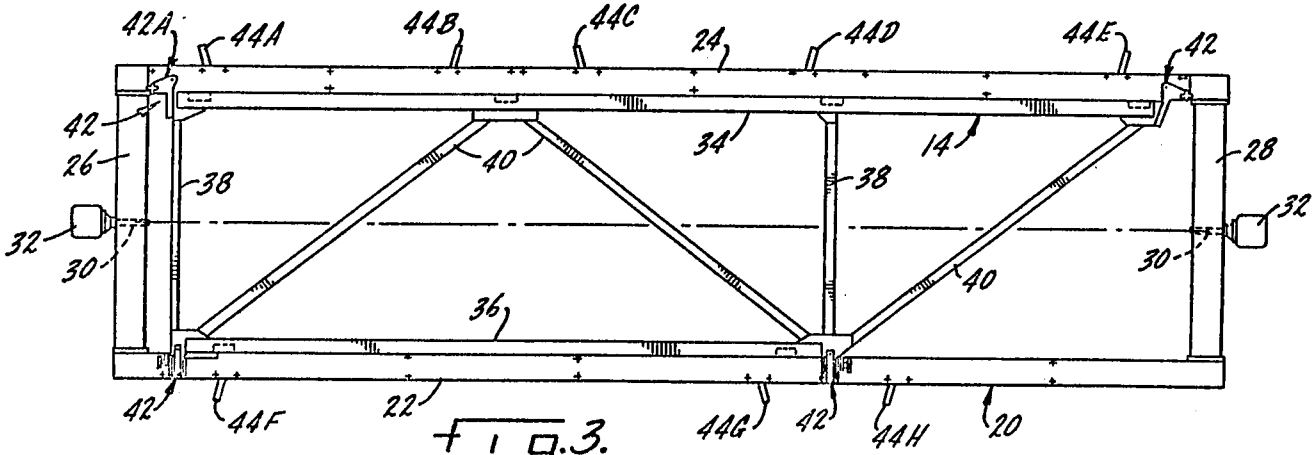
FIG. 3 is a plan view of a welding jig according to the present invention.

FIG. 3 shows the components of an upper truss unit 14 set up in the jig 20, ready for welding. Components of this truss unit include an upper main truss beam 34 and a lower main truss beam 36 along with two orthagonal struts 38 and three angular cross braces 40. The main truss beams 34 and 36 are contiguous with and supported on the first and second longitudinal members 24 and 22, respectively. The beams are held in place by four locator assemblies 42, located at each of the beams 22 and 24. As explained in detail later, these locators 42 are adjustable to clamp the corner of the truss unit between itself and the longitudinal member.

The struts 38 and cross braces 40 are held in place by alignment means comprising a series of clamps 44. These clamps 44 are located so as to hold the struts and cross braces in precise alignment, so that each truss unit 14 welded together in the jig 20 will be precisely according to structural design and will readily fit together with its mating truss units in the frame section 10 (FIG. 1).

FIGS. 4 and 5 show the details of the alignment or clamp assemblies 44A-44H used in the upper truss jig 20. Each clamp assembly, typified by assembly 44B in FIG. 4, includes a linkage, indicated generally at 46, which is made up of a lever 48 and a strap 50 rigidly connected together in fixed angular relation. At the intersection of lever 48 and strap 50, linkage 46 is pivotally connected to the frame as at 52. An over-center spring assembly shown generally at 54 is pivotally connected to the end of strap 50 by a fitting 56 and is pivotally mounted to the jig frame at a trunnion 58. A spring 59 is mounted on rod 57 between trunnion 58 and fitting 56. A clamp member 60 is rigidly attached to strap 50 to complete the clamp assembly 44B.

The other clamp assemblies 44A and 44C-44H are all of the same construction as assembly 44B except for the clamp members 60. Each clamp member 60 is uniquely designed to engage a strut or cross brace (or both) at its particular location. This is done by variation of the angular alignment of the clamp members 60 relative to the members 50 and by use of a notch 61 cut in the clamp member at precisely the proper angle to grab hold of the strut or cross brace and anchor it at the proper angle and position for the particular modular truss unit being assembled.

As can best be seen in FIG. 4, where the two cross braces 40 meet the upper main truss beam 34, between clamp assemblies 44B and 44C, the braces are angles which can be welded to a gusset plate 62 that is affixed to beam 34. The clamp member 60 of each clamp assembly engages the end of one angle brace 40 to hold it in place during welding of the brace to the gusset plate.

All of the alignment assemblies 44A-44H shown in FIGS. 4 and 5 are in their clamping positions. Each is retained in this position by the over-center spring assembly 54. When all the welding is completed truss 14 is removed from jig 20 by releasing all the locators 42 (FIG. 3) and moving the alignment assemblies to their release positions, shown by dash lines 64. To do this, the user manually rotates lever 48 (see arrow A for clamp assembly 44G), causing the strap 50 and clamp member 60 to move away from the truss until the spring assembly 54 moves through an over-center position. Then the spring 59 acts to maintain the alignment assembly in its release position 64 until new components are set up in jig 20 for the next welding procedure. Lever 48 is then pushed back toward the position shown in the drawings to a point where the over-center spring urges the clamp member 60 into engagement with the struts or cross braces.

Stops 66 are mounted on the jig frame to limit the rotational motion of the linkage 46. A further refinement is an adjustment screw 68 in the lever 48, which can be adjusted to change the clamp position for linkage 46 slightly, thus assuring precise location of clamp member 60 and precise angular alignment of the cross brace or strut.

Figure 6:
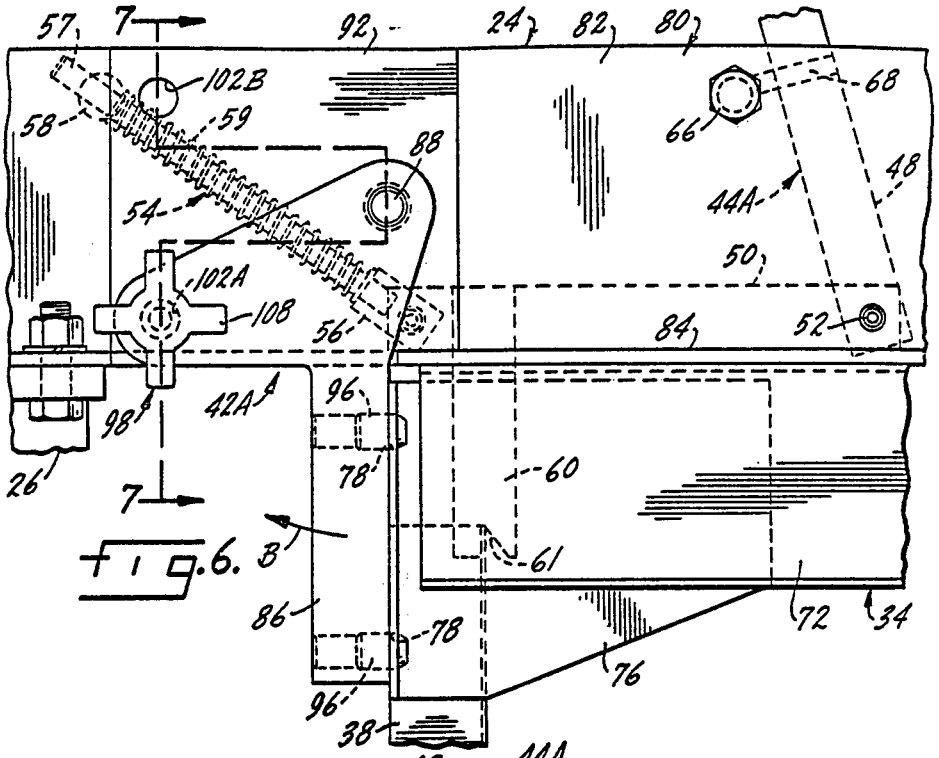
FIG. 6 is a plan view, on a further enlarged scale, of an end locator incorporated in the jig of FIG. 3.
Figure 7:
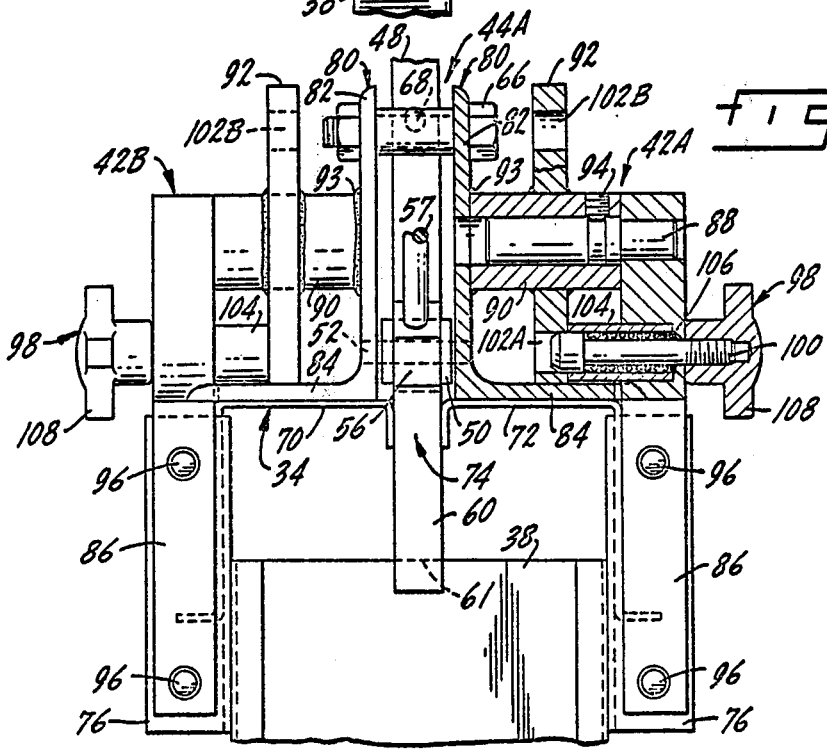
FIG. 7 is an end view, taken approximately along line 7—7 of FIG. 6 showing the locator locking means.

FIGS. 6 and 7 show the details of two locator assemblies 42A and 42B; these particular locators are for the upper left corner of the jig as pictured in FIG. 3. The design shown here is for use in conjunction with the main beam of the type disclosed in the above referred to co-pending application. In this configuration, the upper main truss beams 34 consists of two facing channel sections 70 and 72 (FIG. 7). These channels are spaced so that there is a slot 74 between them, running the length of the beam. At the ends of each channel are flanges 76 having bolt holes 78 for use in subsequent connections of modular truss units. With this beam construction it is convenient to utilize a twin angle configuration, using two angle members 80, for the lateral member 24 of the jig frame. This can be seen in FIG. 7. Each angle 80 has a leg portion 82 and a foot portion 84. The main truss beam 34 is contiguous with the foot section of each angle 80. The alignment (clamp) assemblies 44 are shown in FIG. 6 and in FIG. 7, mounted between the leg portions 82 of angles 80.

The locators 42A and 42B are each associated with one angle 80 of the longitudinal member. Each locator assembly comprises a dog 86 pivotally mounted on a shaft 88 which is connected to the angle 80 by a hub 90. The hub 90 fits through a hole in plate 92 and is welded to leg 82 at 93. A lockscrew 94 retains the shaft 88 in the hub 90. Each dog 86 has two locator pins 96 which fit into the bolt holes 78 of the flange portion 76 on the end of the main truss beam 34. A locking mechanism shown generally at 98 maintains the dog 86 in a clamping position which holds the main truss beam between the dog 86 and the foot 84 of the angle piece 80.

The locking mechanism 98 includes a plunger 100 which fits into two holes 102A and 102B in plate 92. Plate 92 is welded or otherwise fixedly attached to hub 90. A sleeve 104 and spring 106 (FIG. 7) fit into a recess in the dog 86 with the plunger 100 extending therethrough. The outer end of the plunger 100 is threaded and receives a knob 108 which can be used to move the plunger horizontally.

FIGS. 6 and 7 show the dogs 86 in a clamp position with the locking mechanism 98 inserted to prevent any rotation of the dog away from the main truss beam end. When the modular truss unit has been welded together each locator assembly is released by retracting the plunger 100 from hole 102A, allowing dog 86 to be rotated about shaft 88 (arrow B, FIG. 6) until the plunger 100 is aligned with hole 102B. The plunger is then inserted into that hole, thus fixing dog 86 in a released position.

The locators 42 are the same at each corner of the truss jig 20 (FIG. 3), with the exception that the dogs 86 are individually designed for each position.

It can be seen that the modular truss units 11, 12 and 14 can be assembled at any facility equipped for welding and having the standardized jigs such as jig 20. The metal building is fabricated, assembled, and erected using the following procedure. First, the individual truss components such as beams 34 and 36, braces 38 and struts 40 are all fabricated at a central location. This can be done using standard manufacturing techniques and equipment such as roll formers and the like. The individual truss components are then shipped to a local welding facility at an assembly location in the general vicinity of the eventual building site. Shipping the truss components in individual pieces rather than in assembled modules simplifies the handling of the structural elements and materially reduces the freight costs, as compared with shipment of complete truss modules.

At the assembly location the individual components of each truss module are welded together in predetermined combinations and configurations, using standard jigs such as jig 20, to form the modular truss units for a building. This assures accurate controlled fabrication of standardized truss modules while permitting de-centralized assembly of those modules. Furthermore, this procedure retains the full benefits of completely centralized manufacture of the individual components; a single central metal-forming facility can serve a very large area and, indeed, virtually the entire country. Furthermore, the great reduction in freight costs permitted with this arrangement allows for essentially uniform pricing, on a realistic basis, over a broad geographical area.

When fabrication of the truss units for a particular building is completed, those truss units are transported to the building site. The transportation distances are short, because the actual assembly of the truss units occurs at a de-centralized location required to serve only a limited geographical area. At the building site, truss units are erected to form the building frame, which can then be completed by purlins and other longitudinal frame members, following which the covering for the building is mounted on the frame. Because the individual truss units are of limited size, erection can be accomplished with no requirement for cranes or similar heavy erection equipment. The equipment available on an ordinary farm is sufficient.

We claim:

1. An assembly jig for setting up a plurality of truss components, including two main truss beams and a plurality of struts and cross-braces, in a standarized configuration for welding to form a complete truss unit, the jig comprising:

a jig frame having first and second longitudinal members and first and second end members joining the extremities of the longitudinal members to form an open quadrilateral frame wherein the main truss beams, when placed in the jig, are contiguous with the first and second longitudinal members;

mounting means for supporting the jig frame at a height suitable for welding;

a plurality of beam locator means mounted at the corners of the jig frame, each locator means being adjustable to engage one end of one main truss beam so that the locators conjointly releasably locate and clamp the beams along the longitudinal members of the jig frame;

and a plurality of alignment means, mounted at spaced locations along the jig frame, for releasably locating and anchoring the truss and cross-braces of the truss at the proper positions and angles for the particular truss unit configuration, each alignment means including a lever; a rigid strap fixedly connected to the lever such that together they form a linkage, the linkage being pivotally mounted on the frame for movement between a clamp position and a release position; a clamp member, rigidly attached to the linkage, having a configuration which, upon rotation of the linkage into a clamp position, engages one end of a strut or cross-brace member to locate and anchor that member for welding after which, upon rotation of the linkage into a release position, the clamp member disengages the completed truss; and an overcenter spring assembly, attached to the linkage, having a center which is between the linkage release and clamp positions so that the overcenter action retains the linkage in whichever position it has been set.

2. The jig of claim 1 wherein each alignment means further comprises:

stops attached to the frame on either side of the linkage to define the clamp and release positions of the linkage as the overcenter spring assembly urges the linkage into contact with one of the stops.

3. The jig of claim 2 wherein each alignment means further comprises:

an adjustment screw in the linkage which contacts at least one of the stops to provide adjustment of the linkage's clamp position, which in turn adjusts the angular position of the clamp member.

4. The jig of claim 1 wherein each clamp member engages the end of a strut or cross-brace member by means of a notch cut in the clamp member at the proper angle for anchoring the end of the strut or cross-brace member of a particular truss configuration.

5. The jig of claim 4 wherein the linkage and the overcenter spring assembly have a standard configuration common to each alignment means, whereas the clamp member notches and the mounting angles of the clamp member on the linkage vary for each individual truss connection.

* * * * *

UNITED STATES PATENT AND TRADEMARK OFFICE

CERTIFICATE OF CORRECTION

PATENT NO. : 4,245,828

DATED : January 20, 1981

INVENTOR(S) : John Aldag and Willis L. Wells

It is certified that error appears in the above-identified patent and that said Letters Patent are hereby corrected as shown below:

In the designation of the Assignee, cancel "Blackhawk Systems, Inc." and substitute -- Bantam Systems, Inc. --.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*